US006499151B1

(12) United States Patent
Ollinger

(10) Patent No.: US 6,499,151 B1
(45) Date of Patent: Dec. 31, 2002

(54) TOILET BOWL PUMP APPARATUS AND METHOD FOR REDUCING THE WATER LEVEL IN A TOILET BOWL

(76) Inventor: Leslie A. Ollinger, 801 Penrose St., Grinnell, IA (US) 50112

( * ) Notice: Subject to any disclaimer, the term of this patent is extended or adjusted under 35 U.S.C. 154(b) by 0 days.

(21) Appl. No.: 09/631,112

(22) Filed: Aug. 2, 2000

(51) Int. Cl.[7] ..... E03D 9/00
(52) U.S. Cl. ..... 4/255.02
(58) Field of Search ..... 4/255.01, 255.02, 4/255.03, 255.11; 417/511, 514, 550, 555.1, 487, 490

(56) References Cited

U.S. PATENT DOCUMENTS

| | | | | |
|---|---|---|---|---|
| 717,572 | A | * | 1/1903 | Hellums et al. |
| 3,641,597 | A | * | 2/1972 | David et al. ..... 4/255.02 |
| 5,199,114 | A | * | 4/1993 | Christopher ..... 4/255.01 X |
| 5,403,166 | A | * | 4/1995 | Pingiotti ..... 4/255.03 X |
| 5,862,534 | A | * | 1/1999 | Clay ..... 4/255.01 |

* cited by examiner

*Primary Examiner*—Charles E. Phillips
(74) *Attorney, Agent, or Firm*—William L. Klima

(57) ABSTRACT

A toilet bowl pump apparatus and method for reducing the water level in a toilet bowl.

16 Claims, 3 Drawing Sheets

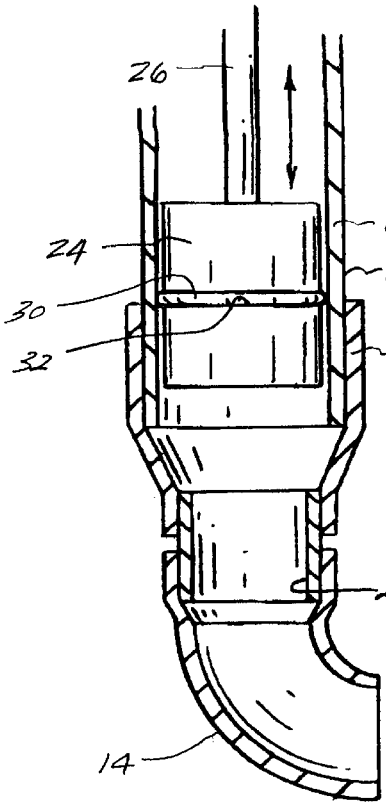
FIG. 2
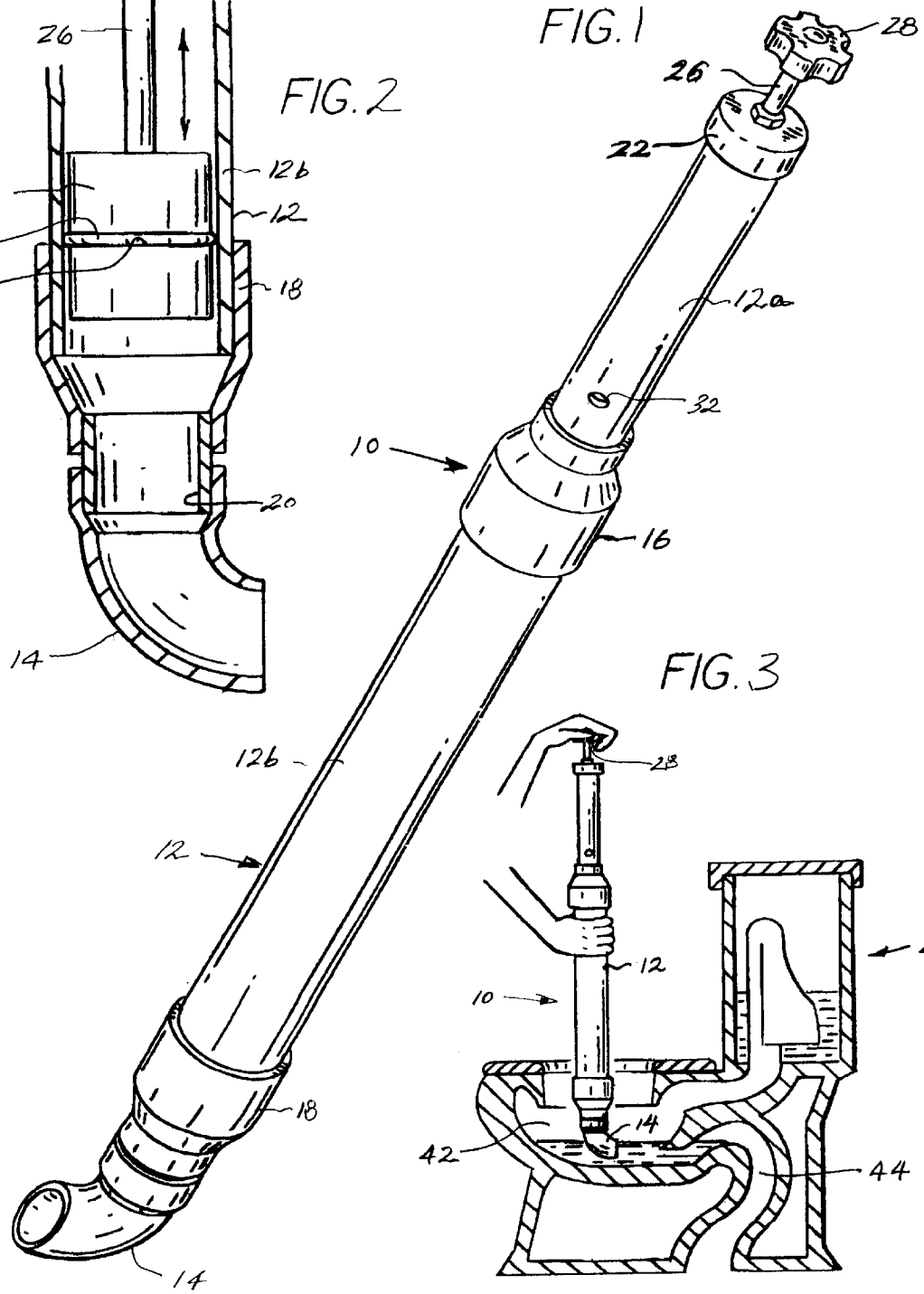
FIG. 1
FIG. 3

TOILET BOWL PUMP APPARATUS AND METHOD FOR REDUCING THE WATER LEVEL IN A TOILET BOWL

FIELD OF THE INVENTION

A toilet bowl pump apparatus and method for reducing the water level in a toilet bowl.

BACKGROUND OF THE INVENTION

In the field of sanitary cleaning and maintenance of toilets, the application of chemical cleaner/disinfectant requires the lowering the water level in the toilet bowls. Specifically, it is desirable to lower the water level in the toilet bowl so that the cleaner/disinfectant can operate at full strength on all surfaces located above and normally below the water level. If the water level in the toilet bowl is not lowered, the cleaner/disinfectant is diluted with the water contained in the toilet bowl, and the cleaner/disinfectant concentration is reduced below a level at which it is effective for both cleaning and disinfectant purposes.

It is current practice to wet mop out a toilet bowl with a device configured like a large cotton swab. This device is configured to enter and clean the toilet bowl drain while forcing water down the toilet bowl drain. A person operating such an existing device must repeatedly plunge the toilet bowl drain for approximately three to five minutes to reduce the water level in the toilet bowl to a sufficient extent necessary for properly cleaning and disinfecting the toilet bowl. Specifically, the water level is preferably reduced at or below the height of the toilet bowl drain.

The existing cleaning operation is time consuming and places the person cleaning the toilet in close proximity therewith making the job a dirty and undesirable job.

Thus, there exists a need for an apparatus and method for reducing the amount of time to reduce the water level in a toilet bowl, and making the job easier and more convenient for a person cleaning toilets.

SUMMARY OF THE INVENTION

An object of the invention is to provide an improved apparatus for reducing the water level in a toilet bowl.

A second object of the present invention is to provide a toilet bowl pump apparatus for suctioning water from a toilet bowl then forcing the water back into the toilet bowl to cause a siphoning effect through the toilet bowl drain reducing the original water level in the toilet bowl for chemically cleaning/disinfecting the toilet bowl.

A third object of the present invention is to provide a toilet bowl pump apparatus including a cylindrical-shaped cylinder with a piston slidably disposed therein.

A fourth object of the present invention is to provide a toilet bowl pump apparatus including a cylindrical-shaped cylinder with a piston slidably disposed therein with an elbow for diverting the water towards the toilet bowl drain.

A fifth object of the present invention is to provide a method of reducing the water level in a toilet bowl including the steps of suctioning the water from a toilet bowl above an existing water level in the toilet bowl and then forcing the water back into the toilet bowl to create a siphoning effect through the toilet bowl drain causing the water level to to be reduced below the existing water level for chemically cleaning/disinfecting the toilet bowl.

The present invention is directed to an apparatus configured to reduce the water level in a toilet bowl for chemical cleaning and disinfecting purposes. The apparatus is preferably a manually operated pump apparatus configured to suction water from the toilet bowl and then subsequently force the water back into the toilet bowl so as to create a siphoning effect through the toilet bowl drain. Alternatively, the device can be configured with a manual or electrically driven pump configured for suctioning the water out of the toilet bowl into the apparatus above an existing water level in the toilet bowl, and then subsequently forcing the water back into the toilet bowl causing the water to be siphoned from the toilet bowl through the toilet bowl drain.

In a preferred embodiment, the apparatus is a hand operated toilet bowl pump configured to suction the water from a toilet bowl above an existing water level in the toilet bowl, and then force the water downwardly into the toilet bowl to create a siphoning effect causing the water to flow into the toilet bowl drain and reduce the existing water level in the toilet bowl to allow cleaning and disinfecting of the toilet bowl with a chemical application. The apparatus includes a cylindrical-shaped housing with a piston slidably disposed therein. The apparatus is configured so that a user can grip a handgrip located on an upper portion of a piston rod connected to the piston and the user can grip the housing with the other hand. When the piston rod is raised the piston creates a suction for drawing liquid into the housing.

In a preferred embodiment, a lower end of the housing is provided with an elbow for diverting the water from a substantially vertical direction to a horizontal direction and directed towards the toilet bowl drain. When the water is forced from the apparatus by the user pushing downwardly on the piston rod, the water is forced from the housing along the elbow and diverted towards the toilet bowl drain. The water diverted towards the toilet bowl drain creates a flow therein creating a siphoning effect that continues to drain water from the toilet bowl through the toilet bowl drain.

BRIEF DESCRIPTION OF THE DRAWINGS

FIG. 1 shows a perspective view of a preferred toilet bowl pump apparatus according to the present invention.

FIG. 2 shows a partial broken away vertical mid cross-sectional view of a lower end of the toilet bowl pump apparatus according to the present invention.

FIG. 3 shows a vertical cross-sectional view of the toilet with the toilet bowl pump apparatus according to the present invention during operation.

DETAILED DESCRIPTION OF THE PREFERRED EMBODIMENTS

Figure 4:
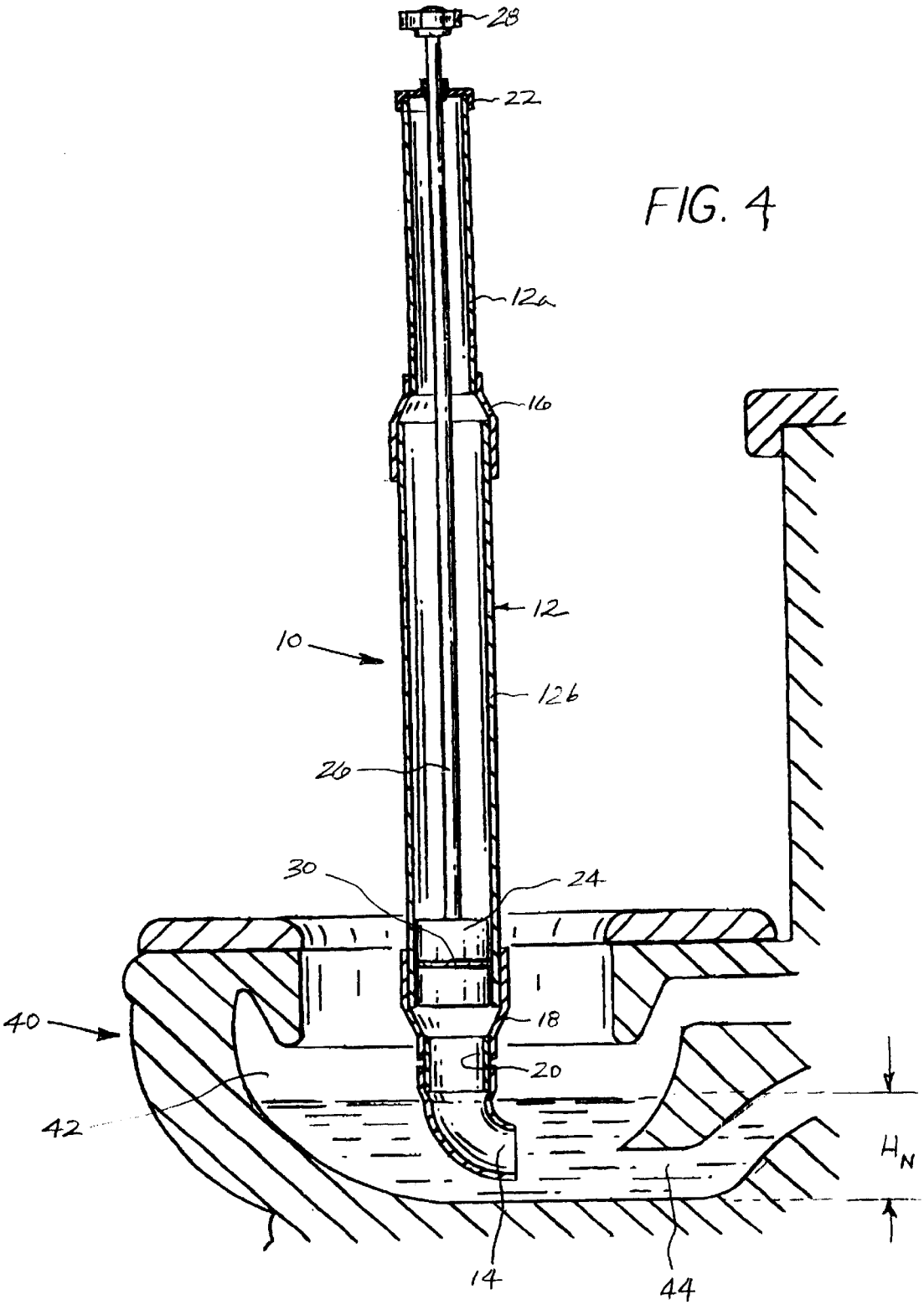
FIG. 4 shows a cross-sectional view of a toilet with a toilet bowl pump apparatus according to the present invention in a mode readied to begin suctioning water from the toilet bowl into the toilet bowl pump apparatus.

A preferred embodiment of a toilet bowl pump apparatus 10 according to the present invention is shown in FIGS. 1 and 2. The toilet bowl pump apparatus 10 includes a housing 12 provided with a smaller diameter upper housing portion 12*a* and a larger diameter lower housing portion 12*b*. An elbow 14 is provided at a lower portion of the housing 12. A first housing reducer portion 16 connects the upper housing portion 12*a* to the lower housing portion 12*b* and a second housing reducer portion 18 connects the lower housing portion 12*b* to the elbow 14 via the additional tubing portion 20. The first housing reducer 16 comprises one end of of a size to receive the smaller diameter upper housing and one end of a size to receive the larger diameter housing portion with a tapering wall connecting the respective ends. The second housing reducer 18 is of simmilar construction. An end cap 22 is provided at the upper end of the upper housing portion 12*a*.

A piston 24 is slidably disposed within the lower housing portion 12*b* of the cylindrical-shaped housing 12. The piston 24 is connected to the lower end of piston rod 26 and handgrip 28 is connected to an upper end of the piston rod 26. The piston rod 26 is slidably disposed through the end cap 22. In a preferred embodiment, the piston 24 is provided with an O-ring 30. Specifically, the piston is provided with a peripheral groove 32 for accommodating the O-ring 30. The upper housing section 12*a* is provided with an air vent 32 to allow air to escape when the piston 24 is drawn upwardly within the housing 12, and allow air to enter the upper housing section 12*a* when the piston 24 is forced downwardly.

The toilet bowl pump apparatus 10 is preferably configured to suction a substantial portion of the water contained in the toilet bowl. For example, the toilet bowl pump apparatus 10 is preferably configured to lower the water level at or below the height $H_D$ (FIG. 5) of the toilet bowl drain 44.

The volumetric capacity of the toilet bowl apparatus 10 for a single stroke of the piston 24 is dictated by the diameter of the piston 24 times the stroke length of the piston 24. Thus, the size of the diameter of the piston 24 and the stroke length of the piston 24 are preferably selected to provide a volumetric capacity sufficient to suction a substantial portion of the water contained in the toilet bowl 42.

Figure 5:
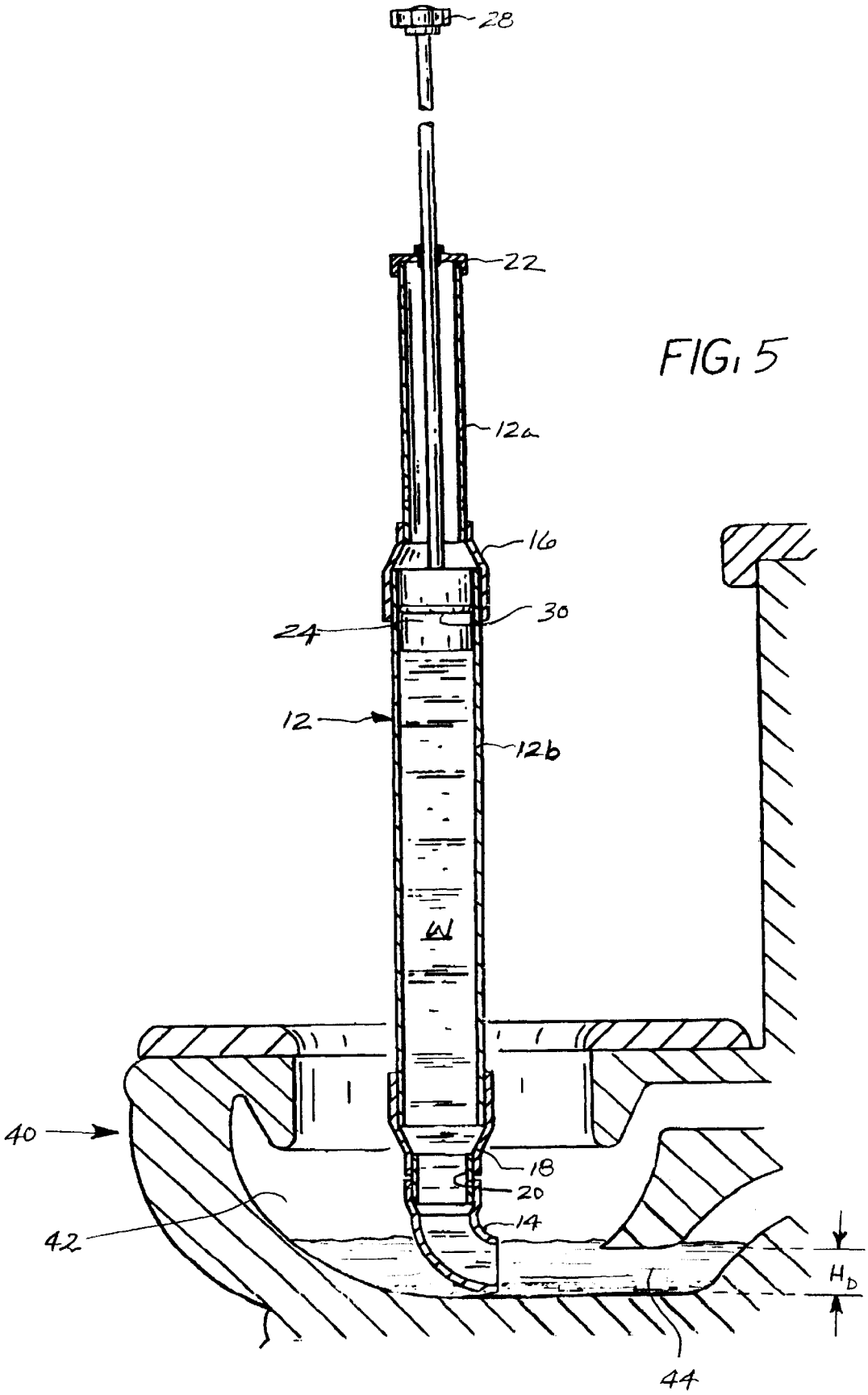
FIG. 5 shows a cross-sectional view of a toilet with a toilet bowl pump apparatus according to the present invention in a mode readied to force the water back into the toilet bowl to create a siphoning effect through the toilet bowl drain to reduce the water level in the toilet bowl.

During operation, as shown in FIG. 3, a person grips the housing 12 with one hand and the handgrip 28 with the other hand while orientating the apparatus 10 in a vertical position. The apparatus 10 is lowered into the toilet bowl 42 until the elbow 14 is positioned near the bottom thereof. The apparatus is rotated so that the elbow 14 is oriented so as to divert the flow of water towards the toilet bowl drain 44. FIG. 4 shows the location of the piston 24 prior to operation of the apparatus 10. In use, the user grabs the handgrip 28 and lifts the same while holding the housing 12 stationary with the other hand. This handling causes the piston rod 26 to draw the piston 24 upwardly to begin drawing water into the elbow 14 by hydraulic effect. The user continues to lift the handgrip 28 upward along the full stroke of the piston 24 until it reaches the position shown in FIG. 5. Then, the user forces the handgrip 28 and piston rod 26 downwardly expelling the water under force and diverting the water towards the toilet bowl drain 44. The water diverted toward the toilet bowl drain 44 causes a flow through the toilet bowl drain 44 including a siphoning effect that continues to drain the water through the toilet bowl drain 44. The end result is that the water level is lowered from the normal water level of height $H_N$ (FIG. 4) to the lowered water level height $H_D$ (FIG. 5).

What is claimed is:

1. A toilet bowl apparatus configured for lowering a normal water level in a toilet bowl to allow chemical cleaning/disinfecting of the toilet bowl, said apparatus comprising:

a housing, said housing including a larger diameter lower housing portion connected to a smaller diameter upper housing portion by a first housing reducer portion, said smaller diameter upper housing portion being provided with a vent hole extending therethrough;

a flow diverter in the form of an elbow, connected to a lower end of said lower housing portion by a second housing reducer portion, said flow diverter configured for placement within the toilet bowl adjacent a toilet bowl drain and diverting water from said housing towards the toilet bowl drain to create a siphon effect that continues to drain water through the toilet bowl drain;

each reducer comprising one end of a size to receive the larger diameter housing portion, a second end of a size to receive a smaller diameter housing portion and a tapering wall connecting the respective ends;

a piston slidably received within said lower housing portion, and configured to slidably travel and operate within said lower housing portion and below said vent hole to allow venting of air located above said piston out of said housing;

a piston rod having one end connected to said piston, said piston rod slidably extending through an upper end of said upper housing portion; and a hand grip connected to an opposite end of said piston rod.

2. An apparatus according to claim 1, wherein the apparatus is configured to substantially lower the water of a toilet bowl approximately at or below a height of a toilet bowl drain.

3. An apparatus according to claim 2, wherein the pump is configured so that a volumetric size of said housing dictated by size of said piston and length of a stroke of said piston are selected to remove substantially all of the water of the toilet bowl during a single stroke of said piston.

4. An apparatus according to claim 1, wherein said flow diverter is a forty-five degree (45°) to ninety degree (90°) angle elbow.

5. An apparatus according to claim 1, wherein said apparatus is configured to limit travel of said piston upwardly within said housing.

6. An apparatus according to claim 5, wherein said travel is limited by provided an upper travel stop within said housing.

7. An apparatus according to claim 6, wherein said travel stop is defined by a transition from said larger diameter lower housing portion, accommodating said slidable piston, to said smaller diameter upper housing portion.

8. An apparatus according to claim 1, wherein said piston is provided with an O-ring.

9. An apparatus according to claim 8, wherein said piston is provided with an outer circumferential groove for accommodating said O-ring.

10. An apparatus according to claim 1, wherein said upper housing portion, first housing reducer portion, lower housing portion, second housing reducer portion, additional tubing portion and elbow are made of plastic.

11. An apparatus according to claim 10, wherein said plastic is polyvinyl chloride (PVC).

12. An apparatus according to claim 10, wherein said upper housing portion, first housing reducer portion, lower housing portion, second housing reducer portion, additional tubing portion and said flow diverter are separate pieces connected together.

13. An apparatus according to claim 1, wherein said housing and elbow are made of plastic.

14. An apparatus according to claim 13, wherein said plastic is polyvinyl chloride (PVC).

15. An apparatus according to claim 1, wherein an additional tubing portion is provided between said second reducer and said elbow.

16. An apparatus according to claim 1, wherein said larger diameter of said lower housing portion is selected to be suitable in size to allow a user to grip said lower housing portion with his or her hand.

* * * * *